US005582476A

United States Patent [19]

Hansen

[11] Patent Number: 5,582,476

[45] Date of Patent: Dec. 10, 1996

[54] ILLUMINATING SAFETY RAZOR

[76] Inventor: James W. Hansen, 34 Mint Cir., Middleburg, Fla. 32608

[21] Appl. No.: 520,072

[22] Filed: Aug. 28, 1995

[51] Int. Cl.[6] ..... B26B 19/46

[52] U.S. Cl. ..... 362/115; 362/32

[58] Field of Search ..... 362/115, 32, 109, 362/396; 30/34.05, 86

[56] References Cited

U.S. PATENT DOCUMENTS

| | | | |
|---|---|---|---|
| 1,440,325 | 12/1922 | Wilhelm | 362/115 |
| 1,950,789 | 3/1934 | Eells | 362/115 |
| 2,311,439 | 2/1943 | Iwanowicz | 362/115 |
| 4,779,173 | 10/1988 | Carr et al. | 362/32 |
| 5,299,104 | 3/1994 | Parmentier | 362/115 |

FOREIGN PATENT DOCUMENTS

| | | | |
|---|---|---|---|
| 878882 | 11/1942 | France | 362/115 |
| 1046876 | 7/1953 | France | 362/115 |

*Primary Examiner*—James C. Yeung

*Attorney, Agent, or Firm*—Arthur G. Yeager; Earl L. Tyner

[57] ABSTRACT

A safety razor having a head that illuminates the area to be shaved. The razor has an internal hollow filled with bundles of optical fiber leading from a source of light within the razor handle to windows directed to the area adjacent the razor blade.

7 Claims, 1 Drawing Sheet

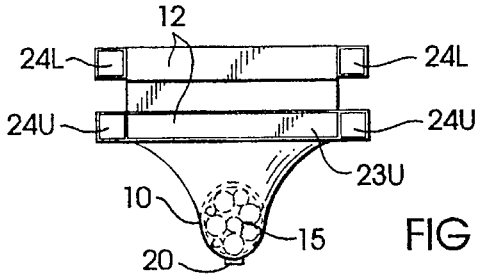
FIG 3
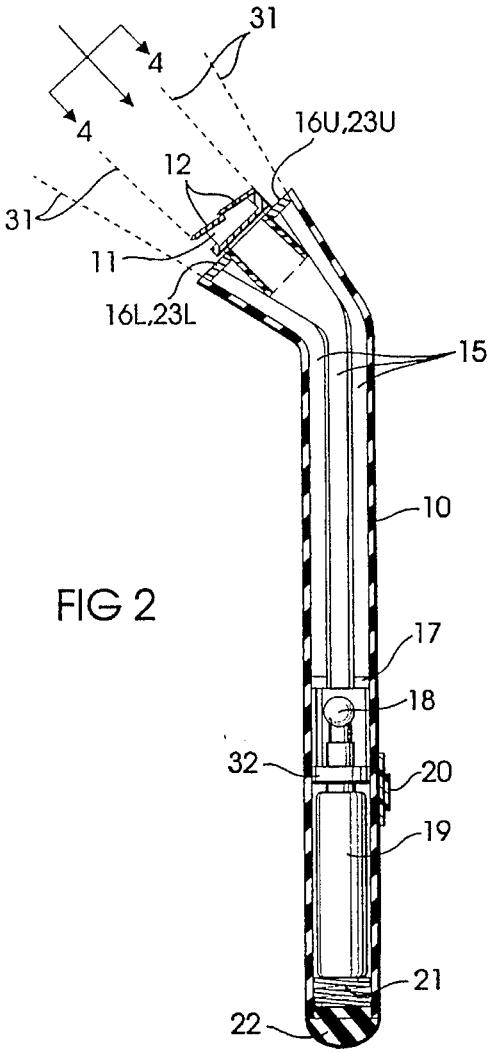
FIG 2
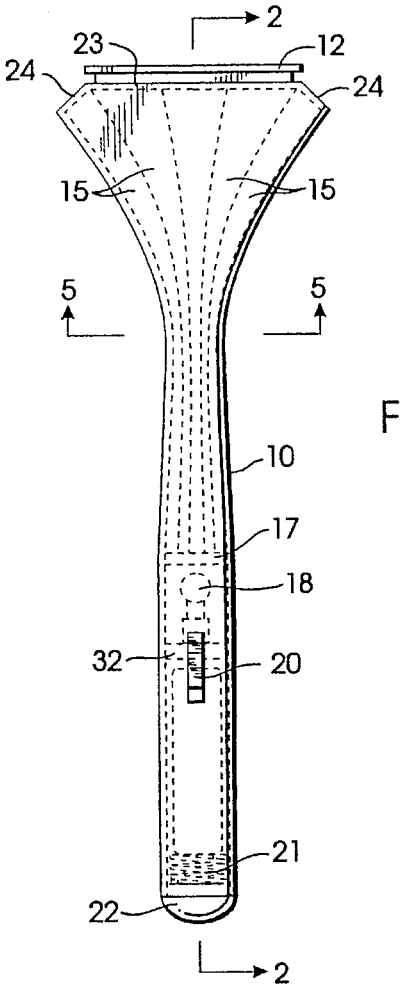
FIG 1
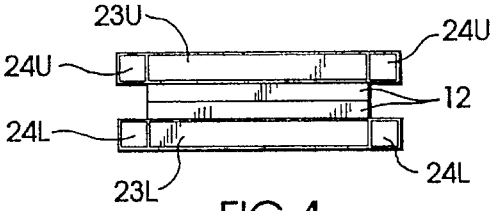
FIG 4
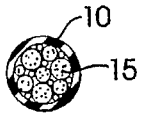
FIG 5
FIG 6
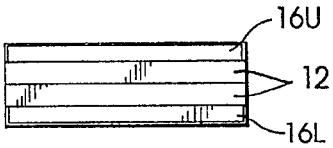
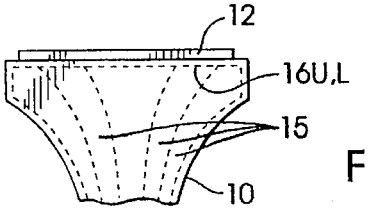
FIG 7

ILLUMINATING SAFETY RAZOR

FIELD OF THE INVENTION

This invention relates to the general technology of safety razors and more particularly, to the area of safety razors that include a means for illuminating the area to be shaved.

BACKGROUND OF THE INVENTION

Safety razors are of many types, the more modern having a slender handle, a curved neck, and a head which receives a cartridge two closely spaced razor blades. Razors made by the Gillette Company are sold in the open retail market today.

The concept of illuminating the area to be shaved by an artificial light source, carried by the razor, is known in the art. See, for example, U.S. Pat. Nos. 1,258,058; 1,440,325; 1,950,789; 3,121,286; 4,094,062; 4,473,943; and 5,299,104. All but one of these patents employs an incandescent bulb as a light source. The last one in the above list employs a fiber optic cable. U.S. Pat. No. 5,299,104 illustrates a support plate that can be clipped to a razor. The support plate provides space for batteries, an incandescent light bulb, and a cable of fiber optic material leading from adjacent the bulb to a narrow rod that bends through a portion of the razor head and ends close to the razor blade. This small end provides the illumination for the shaving. Not only is this inadequate illumination, but the bulky awkwardness of the razor and its support plate makes the entire device unappealing.

It is an object of this invention to provide a novel illuminating safety razor. It is another object of this invention to provide a novel safety razor illuminating the shaving area by fiber optic cables that illuminate the entire length of the razor blades. Still other objects will become apparent from the more detailed description which follows.

BRIEF SUMMARY OF THE INVENTION

This invention relates to an illuminating safety razor adapted to receive and hold a cartridge containing a razor blade. The safety razor includes a head that receives and holds a replaceable cartridge containing a razor blade, and a hollow handle having an internal lengthwise hollow containing lengthwise bundles of strands of optical fibers extending from a first end at a window adjacent said head to a second end at a ferrule adjacent a light-emitting incandescent light bulb. The razor includes a finger manipulable switch for turning the bulb on or off. In a specific and preferred embodiment the light bulb and batteries to provide power for the bulb are entirely enclosed in said handle. In one embodiment the window includes a rectangular window above and below of the razor blade, parallel to the blade. In another embodiment the first window is segmented into a central portion parallel to the razor blade and two end wing segments positioned at angles diverging the light outwardly from the light emitting from the central segment.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 1 is a front elevational view of the safety razor of this invention;

FIG. 2 is a longitudinal cross-sectional view taken at 2—2 of FIG. 1;

FIG. 3 is a top plan view of the safety razor of FIG. 1;

FIG. 4 is an elevational view taken in the direction of 4—4 of FIG. 2;

FIG. 5 is a cross-sectional view taken at 5—5 of FIG. 1;

FIG. 6 is a schematic elevational view similar to FIG. 4 of a second embodiment of the safety razor of this invention; and FIG. 7 is a front elevational partial view of the second embodiment of the safety razor of this invention.

DETAILED DESCRIPTION OF THE INVENTION

The safety razor of this invention is best understood by reference to the attached drawings in conjunction with the following description.

FIGS. 1–5 disclose a first embodiment of this invention wherein the safety razor is substantially of the same size and shape of safety razors made and sold today. The novel features of this invention are found in the handle of the razor, providing illumination of the area to be shaved. The safety razor includes a handle 10 and a head 11 with one or two razor blades 12 in a replaceable cartridge that slides into and out of the head 11, or otherwise attaches to head 11 by a quick-connect attachment means. Handle 10 is hollow. This particular design is not critical, and could include one, two, three, or more internal channels depending rather than one hollow extending lengthwise at handle 10. The hollow contains a plurality of bundles 15 of optical fiber laid lengthwise. At the upper end of the handle, herein called the "first end", there are one or more windows 23, 24 against which the ends of the optical fibers abut. The light from the optical fiber bundles 15 passes through the translucent window or windows 23, 24 and is directed adjacent razor blade or blades 12. In the embodiment illustrated in FIG. 1 are two razor blades 12 and three upper windows 23 U and 24 U above blades 12 and three lower windows 23 L and 24 L below blades 12. In FIG. 2 the spray of light rays 31 is shown by dotted lines from each window 23 U and 24 U and 23 L and 24 L. Each set of three windows (U or L) includes a central window 23 and two wing windows 24 set at an angle to direct light outwardly for the ends of central window 23.

In this first embodiment the optical fiber bundles 15 extend rearwardly to the central portion of the handle 10 to a second window 17 which binds the bundles 15 tightly with the ends of the bundles adjacent to incandescent light bulb 18. Power for bulb 18 comes from battery 19 which fits easily into the rear inside portion of handle 10. A cap 22 with a coil spring 21 causes battery 19 to maintain contact against element 32 which is part of the electrical circuit to turn bulb 19 on or off. Switch 20 on the outside of razor handle 10 is manipulated by the user's finger to turn light 19 on or off.

FIG. 6 shows a second embodiment with a head-on view of blades 12 and single windows 16 U and 16 L, which are coextensive with blades 12 so as to provide maximum illumination.

FIG. 7 shows a portion of the blade-end of this embodiment in elevation, with a hollow handle 10, windows 16 U and L, blades 12, and optic fiber bundles 15.

FIG. 5 shows a cross section taken at 5—5 of FIG. 1 indicating how the interior hollow of handle 10 is filled with bundles of optical fibers to transmit light from bulb 18 to windows 16, 23, and 24.

The difference between the first and second embodiments is in windows 16, 23, and 24. In the first embodiment each window is broken into three segments. The upper window has a central segment 23 U and two similar wing segments 24 U. The lower window has a central segment 23 L and two similar wing segments 24 L. This embodiment diverts some of the light from the bundles 15 of optical fiber to angle that light outward away from that omitted by central segments 23 U and 24 U. This feature provides better illumination at the outer edges of blades 12. In the second embodiment there is a single upper window 16 U and a single lower window 16 L, each window coextensive with blades 12, and thereby concentrates the available light at the blades 12 with no outwardly angled illumination. Other than the diverting of some light from the upper and lower windows the remaining features of these embodiments are the same.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An illuminating safety razor having a head adapted to receive and hold a cartridge of at least one razor blade, and a hollow handle having a lengthwise internal hollow channel containing a plurality of parallel lengthwise strands of optical fiber, said channels and said strands terminating at a first end adjacent said head at an elongated transverse window adapted to direct light to the user's skin along the entire length of the cutting edge of said blade and at a second end in a ferrule that clamps said strands together holding the ends of said strands adjacent a source of light, and a finger manipulable switch to turn said light on and off.

2. The safety razor of claim 1, wherein said source of light is a light bulb and a suitable battery housed in said hollow channel.

3. The safety razor of claim 1, wherein said window is a flat planar translucent plate parallel to said razor blade.

4. The safety razor of claim 4, wherein two parallel windows are present at said first end; one of said two being above said blade and the other of said two being blow said blade.

5. The safety razor of claim 1, wherein said window includes three planar segments; a central large segment positioned parallel to said razor blade, and two wing segments positioned at angles to said central segment and adapted to direct light outward laterally away from the light from said central segment.

6. The safety razor of claim 2, wherein said ferrule is a clamping band around said bundles of optical fiber, all of said bundles terminating in a single planar cut end substantially perpendicular to the lengthwise direction of said optical fibers.

7. The safety razor claim 4, wherein each of said two parallel windows includes three planar segments; a central large segment positioned parallel to said razor blade, and two ring segments positioned at angles to said central segment and adapted to direct light outward laterally away from the light from said central segment.

* * * * *